United States Patent [19]

Klöber

[11] Patent Number: 4,508,580

[45] Date of Patent: Apr. 2, 1985

[54] INCENDIARY MIXTURE CONSTITUTED OF METALS

[75] Inventor: Martin Klöber, Nuremberg, Fed. Rep. of Germany

[73] Assignee: Diehl GmbH & Co., Fed. Rep. of Germany

[21] Appl. No.: 555,708

[22] Filed: Nov. 28, 1983

[30] Foreign Application Priority Data

Dec. 11, 1982 [DE] Fed. Rep. of Germany ..... 3245907

[51] Int. Cl.[3] ..... C06B 45/10

[52] U.S. Cl. ..... 149/19.91; 149/40; 149/41; 149/42; 149/43; 149/44; 149/45; 149/61; 149/70; 149/75; 149/76; 149/77; 149/85; 149/109.6

[58] Field of Search ..... 149/19.91, 40, 41, 42, 149/43, 44, 45, 61, 70, 75, 76, 77, 85, 109.6

[56] References Cited

U.S. PATENT DOCUMENTS 3,025,153 3/1962 Cross ..... 149/40

*Primary Examiner*—Stephen J. Lechert, Jr.

*Attorney, Agent, or Firm*—Scully, Scott, Murphy & Presser

[57] ABSTRACT

An incendiary mixture which is constituted of metals with at least one oxygen-supplying metal oxide and an organic binder, and/or a nitrate, chlorate, perchlorate or peroxide selected from the group of elements consisting of sodium, potassium, lithium, barium, strontium, as well as compounds of ammonium.

12 Claims, No Drawings

INCENDIARY MIXTURE CONSTITUTED OF METALS

BACKGROUND OF THE INVENTION

1. Field of the Invention

The present invention relates to an incendiary mixture which is constituted of metals with at least one oxygen-supplying metal oxide and an organic binder, and/or a nitrate, chlorate, perchlorate or peroxide selected from the group of elements consisting of sodium, potassium, lithium, barium, strontium, as well as compounds of ammonium.

2. Discussion of the Prior Art

Granulated incendiary charges which are compressed under high pressure into applicable active carriers, such as ballistic nose cones or projectiles, have become known from German Published Patent Application Nos. 29 01 517 and 27 52 946. These incendiary charges are always present in the form of a granulated compound which is compressed under high pressure into a solid mass. It is disadvantageous that the incendiary compound can only be worked into active carriers which possess geometrically suitable configurations, such as, for instance, cylindrical or conical shapes, since only in that manner will the incendiary compound permit itself to be optimally compressed.

From German Pat. No. 25 30 209 an incendiary medium has become known, which is constituted of metals with an oxygen-supplying component and an organic binder. The binder is of a relatively viscous consistency and is yieldably-elastic subsequent to its hardening. It evidences a relatively low mechanical stability. Consequently, it is not suitable as a constructional component in projectiles and flying bodies due to the usual accelerations, since the components which are to be supported within the projectile can readily displace. For effecting the triggering of the incendiary medium, there is required the detonation of a usual explosive.

SUMMARY OF THE INVENTION

Accordingly, it is an object of the present invention to provide an easily castable incendiary medium which, subsequent to hardening, forms a mechanically and thermally stable incendiary medium for ammunition, such as hand grenades, firearms, projectiles, combat elements, and mines.

The foregoing object is achieved pursuant to the invention in an incendiary mixture as described hereinabove, in which the oxygen-supplying component consists of one or two oxygen-supplying compounds, such as barium nitrate or lead-IV-oxide and/or iron-III-oxide; one or two pyrophoric components, such as magnesium or aluminum alloys, or zircon, and wherein the mixture contains a castable binder, such as methacrylate resin or other suitable synthetic resins.

The inventive incendiary composition is extremely fluidic and allows itself to be cast like a synthetic resin. It will harden or set after a predeterminable time interval. In the hardened condition it can be mechanically worked, such as through turning, milling or drilling, without danger of igniting. It possesses an extremely high temperature stability and intensively bonds with other materials. During the impact of ammunition of high kinetic energy, which is provided with the incendiary medium, the triggering of the incendiary medium is already ensured due to the conversion of the kinetic energy. For ammunition with a low kinetic energy, at impact against a target the igniting of the mixture is effected by means of the detonation of the explosive in the ammunition.

Through the high viscosity of the binder, which can reach up to about 5000 cP, in accordance with the component and type of the binder and the incendiary composition, there is obtained a fluidic composition which can be cast into any shape and to harden or set therein. In accordance with the quantity and type of the catalyst employed, the hardening takes place within a few seconds up to a number of hours. The set material is hard and only slightly elastic. The viscosity of the fluidic composition can be adjusted in a known manner, if required, to a viscous consistency.

The inventive incendiary medium distinguishes itself in its suitability for the casting of heretofore unusable hollow spaces in projectiles and other active carriers; for example, infantry grenades, artillery projectiles, mortar projectiles, mines, and hand grenades. Consequently, it is now possible that for ammunition, wherein no space was heretofore available for incendiary compositions, that there can be made provision for an incendiary component. Moreover, in predetermined instances, the inventive incendiary medium is also adapted to replace previously employed plastic constructional components by means of the incendiary composition; thus, constructional fragments which were previously foamed into plastic can be cast together with the incendiary medium, or preformed components in projectiles or in flying bodies could be replaced by components constituted of the incendiary composition. Because of the high mechanical and thermal stability of the described incendiary medium, it is also possible in predetermined instances that ballistic nose cones can serve for the receipt of incendiary media, through replacement of the solid body which is cast or molded onto the projectile with the incendiary medium. In the same manner it is possible that normal ballistic nose cones of light weight metals, in lieu of heretofore being form pressed with incendiary compositions, be cast with the inventive incendiary medium, which represents an enormous cost saving. Through the suitable selection of the binder, the incendiary medium also fulfills the function of a threaded connection.

In the production of the incendiary medium, metal oxide or metal oxides and the pyrophoric components are admixed while dry. The dry mixture is then stirred with the liquid binder and can thus be further processed. The formation of the dry mixture does not require any special precautions since the maintaining of the addition of components or the encompassing of an incendiary component with phlegmatizing materials reduces the ignition probability. The mixture is, accordingly, produceable in a simple and inexpensive manner. The mixing thereof is also safe since there is no danger of any spontaneous ignition or detonation taking place during the mixing. The assembling of the mixture is at no time sensitive to ignition. Also during the processing thereof through casting and subsequent to the hardening or setting of the material there is not encountered any danger of detonation.

The fluidic binder, selected from the group of methacrylates or other suitable synthetic resins, moistens the individual powder particles of the incendiary composition, so that the ratio of the dry incendiary composition to binder is advantageous, and thereby this raises the ignition response sensitivity. Also produced thereby is a good degree of incendiary output.

The basis of the incendiary mixtures are proven and known incendiary compositions. These are modified in their oxygen balance and, in a first example, admixed with a known anaerobic binder which is based on methacrylate resin, and eventually mixed with a suitable accelerant.

This adhesive hardens at room temperature in combination with metal or metal compounds and the preclusion of atmospheric oxygen. It is normally utilized for threaded connections. The viscosity of the binder can range up to about 5000 cP. This mixture is utilized for the internal cladding of tubular projectiles, since through the addition of catalysts it is possible to achieve hardening or setting within seconds.

The mixture possesses the following composition:

Barium nitrate, $BaNO_3$: 15% by weight

Iron(III)oxide, $Fe_2O_3$: 40% by weight

Mg/Al alloy,: 24% by weight

Zircon, Zr: 20% by weight

The dry mixture is stirred together with a further 25% weight of the above-mentioned binder, and is also so further processed.

Another suitable, commercially available binder is used as a synthetic resin concrete binder, or quick-adhesive for concrete. It hardens during catalyst addition. In accordance with the quantity and type of the catalyst employed, the setting at room temperature or at about 60° to 80° C. is effected within about 0.5 to 24 hours; in effect not as rapidly as the previously mentioned binder.

It is utilized for the production of larger volume incendiary composition components, for example, fragmentation cages which are bonded with incendiary compositions. It allows itself to be easily cast.

The mixture possesses the following composition:

Lead(IV)oxide, $PbO_2$: 44% by weight

Iron(III)oxide, $Fe_2O_2$: 9% by weight

Mg/Al alloy: 23% by weight

Zircon, Zr: 21% by weight

Pulverulent Hardener: 3% by weight

The dry mixture is stirred together with a further 23% by weight of the above-mentioned binder; however, without an amine accelerant, and thus can be further processed.

Another commercially available binder is employed as casting resin or an embedding composition.

It sets within about 1 to 24 hours (in accordance with the temperature and catalyst). Obtained is a viscous and somewhat elastic finish product.

Besides the methacrylate resins there are also suitable other correspondingly modified synthetic resins.

What is claimed is:

1. In an incendiary mixture containing metals with at least one oxygen-supplying metal oxide and an organic binder; and a nitrate, chlorate, perchlorate or peroxide selected from the group consisting of sodium, potassium, lithium, strontium, and ammonium and the chlorate, perchlorate or peroxide of barium comprising the improvement where the oxygen-supplying component consists of at least one oxygen-yielding compound selected from a member of the group consisting of barium nitrate, lead-IV-oxide and iron-III-oxide and mixtures thereof; at least one pyrophoric component selected from the group consisting of magnesium alloys, aluminum alloys or zirconium; and a castable acrylic synthetic resin binder.

2. Mixture as claimed in claim 1 wherein said oxygen-yielding component comprises 10 to 15% barium nitrate and 30 to 35% iron-III-oxide, the pyrophoric component comprises 17 to 22% magnesium alloy and aluminum alloy, and 14 to 18% by weight of zirconium, and said binder comprises 18 to 20% by weight of a methacrylate resin.

3. Mixture as claimed in claim 1 wherein the oxygen-yielding component comprises 33 to 40% by weight of lead-IV-oxide and 6 to 10% by weight of iron-III-oxide; the pyrophoric component comprises 15 to 22% by weight of magnesium alloy and aluminum alloy and 18–20% of zirconium; and the binder comprises 18 to 20% by weight of a methacrylate resin.

4. Mixture as claimed in claim 1 wherein the oxygen-supplying component comprises 42–46% by weight, the pyrophoric component 34 to 38% by weight, and the binder component 18 to 22% by weight.

5. In a process for the production of incendiary mixtures containing metals with at least one oxygen-supplying metal oxide, an acrylic resin binder and a nitrate, chlorate perchlorate or peroxide selected from a member of the group consisting of sodium, potassium, lithium, strontium and ammonium and the chlorate, perchlorate or peroxide of barium, an oxygen-supplying component consisting of at least one oxygen-yielding compound selected from a member of the group consisting of barium nitrate, lead-IV-oxide and iron-III-oxide; at least one pyrophoric component selected from the group consisting of magnesium alloys, aluminum alloys or zirconium comprising forming a dry mixture of the oxygen-supplying components, the pyrophoric components, adding said acrylic resin binder while stirring and subsequently adding a catalyst for surface hardening said binder.

6. A composition of matter for manufacturing ammunition comprising an incendiary mixture consisting of metals with at least one oxygen-supplying metal oxide, an acrylic resin binder and a nitrate, chlorate, perchlorate or peroxide of a member selected from the group consisting of sodium, potassium, lithium, strontium and ammonium and the chlorate, perchlorate or peroxide of barium.

7. An adhesive for threaded connections in ammunition comprising the composition of claim 6.

8. A filler material for hollow spaces in ammunition comprising the composition of claim 6.

9. A carrier composition for preformed ammunition fragments in ammunition comprising the composition of claim 6.

10. An insert for ballistic nose cones in ammunition comprising the composition of claim 6.

11. An insert for projectile members in ammunition comprising the composition of claim 6.

12. A support member for the replacement of plastic components in ammunition comprising the composition of claim 6.

* * * * *